US005513585A

United States Patent [19]

Diekmann et al.

[11] Patent Number: 5,513,585

[45] Date of Patent: May 7, 1996

[54] APPARATUS FOR CUTTING AND TURNING PIPED OPENINGS IN CLOTH WORKPIECES

[75] Inventors: Herbert Diekmann, Vlotho; Herbert Struck, Iohne; Heinz Goldbeck; Dietrich Kähler, both of Bielefeld, all of Germany

[73] Assignee: Dürkopp Adler Aktiengesellschaft, Germany

[21] Appl. No.: 261,839

[22] Filed: Jun. 17, 1994

[30] Foreign Application Priority Data

Jun. 23, 1993 [DE] Germany ..... 43 20 739.1
Apr. 9, 1994 [DE] Germany ..... 44 12 230.6

[51] Int. Cl.[6] ..... D05B 37/02; D05B 3/06

[52] U.S. Cl. ..... 112/68; 112/129

[58] Field of Search ..... 112/66, 67, 68, 112/405, 406, 129, 147; 83/905

[56] References Cited

U.S. PATENT DOCUMENTS 1,945,104 1/1934 Zilinsky ..... 112/405
2,529,072 11/1950 Bradford et al. ..... 112/65
2,573,359 10/1951 Rich ..... 112/65
4,665,843 5/1987 Goldbeck et al. ..... 112/68

FOREIGN PATENT DOCUMENTS 878299 4/1953 Germany .
2252490 10/1990 Japan ..... 112/68
750764 6/1956 United Kingdom .

*Primary Examiner*—Ismael Izaguirre
*Attorney, Agent, or Firm*—Ostrolenk, Faber, Gerb & Soffen

[57] ABSTRACT

A device for cutting and turning a piped opening in a cloth workpiece which includes a main piece of cloth and a cloth strip sewed to it. The workpiece has a slit, and corner cuts are formed at the slit ends by corner knives with the workpiece lying on a support plate. Turning tools are introduced into the slit at positions located spaced from the corner cuts. The turning tools are then moved apart toward positions located closer to the corner cuts and thereupon lowered, so as to turn the piped opening. Inserting devices may be provided for initially pushing at least part of the workpiece into the slit before being engaged by the turning tools. An orienting device furthermore may orient the workpiece at an acute angle or perpendicular to the support plate for being engaged by the turning tools.

34 Claims, 5 Drawing Sheets

APPARATUS FOR CUTTING AND TURNING PIPED OPENINGS IN CLOTH WORKPIECES

BACKGROUND OF THE INVENTION

The present invention relates to an apparatus for making braided, bound or piped openings in cloth workpieces, and more particularly to an apparatus for cutting and then turning or reversing the opening.

Federal Republic of Germany patent 878,299 (corresponding to U.S. Pat. No. 2,573,359) discloses a machine for the manufacture of edged buttonholes in which turning fingers having rib-shaped projections are developed on supports for corner knives. This document and all other prior art documents mentioned herein are expressly incorporated by reference. In order to effect corner cuts and turning, the corner knives, with turning fingers, are passed through the slit which has already been produced in the piece of cloth. The corner cuts are first produced. Upon further movement of the supports, the turning fingers are passed through the slit, turning over the piece of cloth upon their rearward movement.

In accordance with the German patent, the supports for the corner knives and the turning fingers are slidable in horizontal direction individually and/or together in a carriage which is mounted for displacement in vertical direction in a fixed support. A piston-cylinder drive initiates an operating movement of the carriage via a lever, from which movement a drive for the supports is tapped off by a pin/curved-groove mechanism. To this extent, movements of the supports in those directions, which are associated with each other in a fixed manner, are produced.

By producing the movement described, the movement of the supports always takes place at right angles to the piece of cloth but, with increasing penetration into the slit, also increasingly in the direction towards the corner cuts. In this way, the turning fingers extend far into the previously produced corner cuts, the rib-shaped projections even extending beyond the end points of the corner cuts. This can result in distorting the clamped pieces of cloth or, in the case of material of sensitive quality, even damaging the end points of the corner cuts. On the other hand, the function of such turning fingers requires that the edges of the cloth to be turned be dependably caught on the edges or projections of the turning fingers.

A similar machine is disclosed in U.S. Pat. No. 2,529,072.

The above devices can be used only to a limited extent in view of the described difficulties.

British patent 750,764 discloses a device for turning braided openings in articles of clothing including a turning tool which consists of several metal plates. With this device, barb-like edges of the plates positively engage the edges of the cloth workpiece to be turned, upon the pulling back of the turning tool, and grip the piece of cloth to be turned. The length of the turning tool corresponds to the length of the braided opening.

As compared with the first-mentioned device, this device has the disadvantage that suitable turning tools must be used for different lengths of openings. On the other hand, the first-mentioned device operates only in the region of the corner cuts, and can be adapted with respect to different lengths of openings.

SUMMARY OF THE INVENTION

The object of the present invention is to provide an apparatus for cutting and turning braided openings in cloth workpieces, which can cut and reliably turn the workpieces substantially without distortion.

This object may be achieved in accordance with an aspect of the invention by an apparatus for cutting and turning braided, bound, or piped openings in workpieces which include a strip sewn by seams onto a main piece, with a slit formed between the seams, the workpiece being fixed to a support plate by a pair of clamps. Two corner knives are displaceable at least vertically for making end cuts. Reversing tools can be introduced into the slit from below for reversing the fabric strip after cutting, the reversing tools being horizontally movable independently of the corner knives and having an upper position in which they can be shifted in opposite directions away from one another in the longitudinal direction of the slit.

The apparatus performs the following operating steps:

a) the workpiece is positioned on a support plate with the slit above the corner knives and turning tools, b) corner cuts are produced in the workpiece at the ends of the slit, c) the turning tools are moved upward through the slit at positions spaced from the corner cuts, d) the turning tools are then moved into positions located close to the corner cuts, e) the turning tools are then pulled downward and out of the workpiece in order to complete the turning of the braided opening.

By these means, the braided opening in the workpiece is provided with corner cuts and then turned. For the turning operation, the turning tools are introduced into the slit in the workpiece at positions spaced from the corner cuts and thereby, initially, have more free space in the slit and thus penetrate into the slit with relatively little resistance. On the other hand, the edges of the cloth are dependably grasped by moving the turning tools into positions located close to the corner cuts, as a result of which the edges of the workpiece are more dependably hooked by the edges of the turning tools.

In more detail, the apparatus for carrying out the above operations may have the following features:

a support plate for the workpiece, corner knives for producing corner cuts at the end of the slit, turning tools with edges for turning the braided opening in the workpiece, first bearings in which the turning tools are received for displacement parallel to the slit, second bearings in which the corner knives and the turning tools are displaceably received between a lowered position and an extended position for carrying out respective operating movements, a first drive for the displacement of the turning tools parallel to the slit, and a second drive for carrying out the operating movement of the corner knives and the turning tools.

The second bearings and the second drive advantageously have independent bearing parts and drive parts for the corner knives and the turning tools, and the first drive has at least one positioning drive for guiding the turning tools upon the entrance into the slit at positions remote from the corner cuts, and then, after reaching the extended position, before carrying out the movement which turns the braided opening in the workpiece, the turning tools are moved into positions close to the corner cuts.

The at least one positioning drive advantageously has a stroke-adjustment device, to adapt the positions of the turning tools as a function of the actual dimensions and conditions of the workpiece, including the thickness and/or the quality of the cloth.

The positioning drive may have a piston-cylinder drive or a stepping motor. While the former permits an inexpensive and reliable construction, the latter leads to a construction which can be directly electrically controlled.

The bearing parts for the corner knife and the turning tool are preferably developed on a bearing bracket, thus combining structural parts. This results in taking up less structural space, reducing manufacturing costs, and increasing reliability of operation. With this development, furthermore, the adjustment of the device to different sizes of the braided opening is simplified.

The second drive parts are preferably developed as piston-cylinder drives on the bearing brackets, which leads to inexpensive and dependable construction.

A size-setting device is preferably provided for setting the corner knives and the turning tools in a direction parallel to the slit in accordance with the lengthwise dimension of the braided opening. The positioning drive may be developed as a servomotor or stepping motor for the size-setting device.

The turning tool may include a plate which has engaging edges. Two plates may be provided having edges which form a stepped shape. A stripper partially comprising a friction-increasing material such as rubber or Vulkollan may be provided on the turning tool. These features permit dependable grasping of the edges of the cloth of the braided opening to be turned.

According to a second aspect of the invention, the corner knife and the turning tool may be mounted on separate bearing brackets, giving improved flexibility.

In a third aspect of the invention, there may be an inserting device above the workpiece support surface which can be lowered so as to push the workpiece partially into the slit, before it is grasped by the reversing tools. Bound or piped openings for so-called selvage pockets can be reversed with an apparatus having such a feature. A selvage pocket may be a hip pocket in trousers, for example.

The cross-section of the piping strip of a selvage pocket is not folded in the form of an inverted T, as is the case with other pockets. Instead, piping, and therefore also folded fabric, is provided only on one side of the pocket. The excess length from the associated seam to the outer edge of the fold is relatively large.

The other side of the piping strip, which is not folded, can be somewhat broader than usual. During reversing, this part is also pulled through the slit in the article of clothing and later serves for sewing on the pocket.

By partially inserting the fabric strip into the slit, it is made certain, even in the most unfavorable case, that the reversing tools can reliably take hold of the fabric edges for pulling them into the slit.

The inserting device preferably may be lowered at an angle for partially introducing the fabric strip into the slit, to avoid any impediment to the reversing tools, which move perpendicularly.

Moreover, two inserting devices, spaced away from each other in the longitudinal direction, are preferably provided, so that one device is assigned to each reversing tool, which improves the reliability of taking hold of the edge. In a particularly advantageous embodiment, the distance between the devices can be adjusted. Thus the correspondence between the inserting devices and the reversing tools can be retained when the cutting and reversing devices are adjusted.

The inserting device for pushing the fabric strip into the slit preferably has an end piece constructed on the piston rod of a fluid pressure cylinder. As a result, the apparatus is particularly flexible, because the selection of the pressure cylinder can be simply adapted to the necessary downward path, which results from the arrangement of the pressure cylinder above the support plate.

It is also possible to provide a raising device, above the support plate, with which the fabric strip can be brought into a raised position, essentially parallel to the reversing tools. This additional device will make certain that large or very flexible fabric parts, which fold over because of their own weight, can be taken hold of reliably by the inserting device that can be lowered and pushed into the slit.

In this connection it is advantageous if this raising device also has a pressure cylinder, is connected with the fabric clamp and has a piston rod which is connected to a metal plate so that it can be tilted up and down. The fabric strip, lying on the metal plate, is then tilted up in a simple manner.

When viewed in the longitudinal direction, the device for pushing the fabric strip into the slit preferably is disposed between the reversing tools.

The fabric clamping part for the folded fabric strip can furthermore be shifted, preferably in the direction of the other fabric clamping part. By these means, the associated fabric strip is shifted closer to the reversing tools, so that the fabric strip can be reliably taken hold of, and the edge can be gripped more reliably as well.

BRIEF DESCRIPTION OF THE DRAWINGS

Other features and advantages of the present invention will become apparent from the following description of three embodiments of the invention, with reference to the accompanying drawings, in which.

DETAILED DESCRIPTION OF EMBODIMENTS OF THE INVENTION

Figure 1:
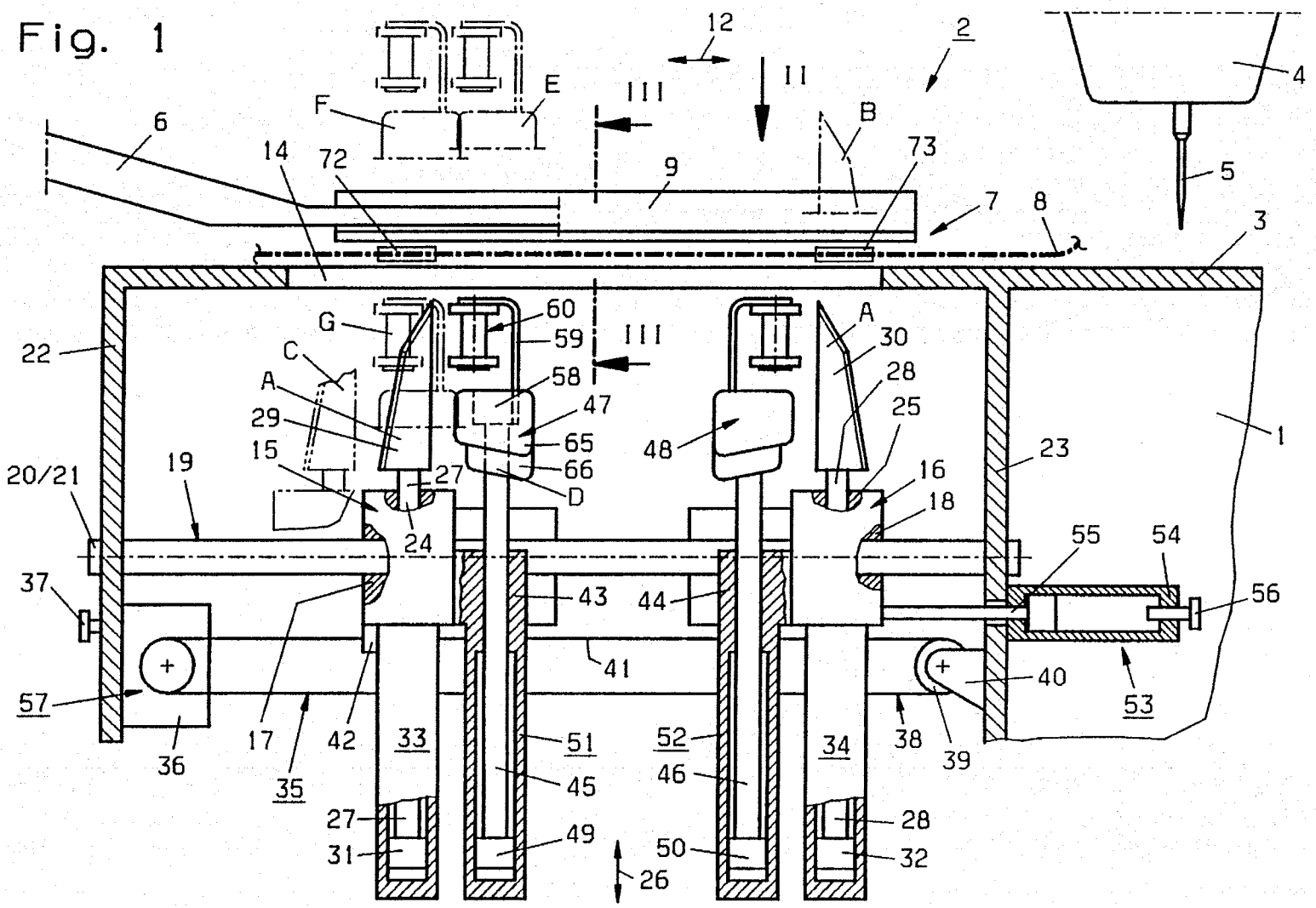
FIG. 1 is a front view of a device according to a first embodiment of the invention having a frame shown in cross-section.

A frame 1 of a sewing system 2 has a support plate 3 on which a sewing machine 4 with needles 5 is received.

Furthermore, the sewing system 2 is provided with a cloth clamp 6 which rests on a cloth workpiece 7 lying on the support plate 3.

The workpiece 7 has a main piece 8 and a strip folded approximately into a T-shape, these parts 8, 9 being sewn together by two seams 10, 11 which extend parallel to each other. The seams 10, 11 are of finite length and extend in the direction indicated by a double-ended arrow 12. The direction of the double-ended arrow 12 is, in its turn, parallel to the support plate 3. The cloth clamp 6 is mounted in supports (not shown) on the frame 1 for displacement back and forth, also in the direction of the double-ended arrow 12. Furthermore, a slit 13 of finite length is made in the workpiece 7 between the seams 10, 11, i.e. the parts 8, 9 are cut through completely.

Figure 2:
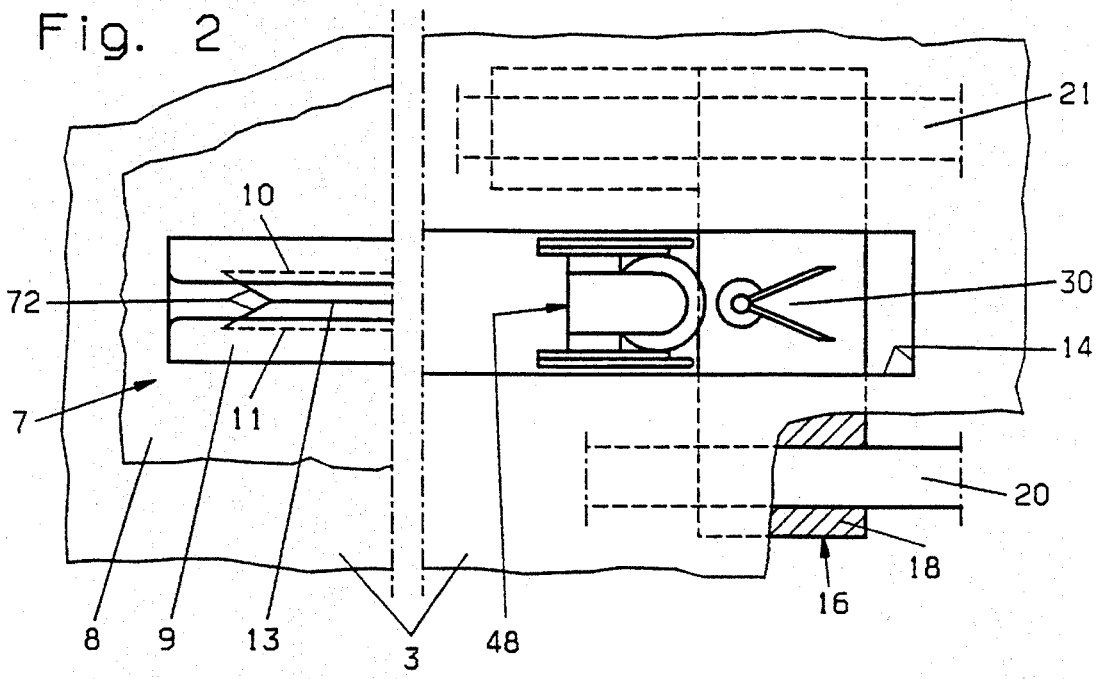
FIG. 2 is a top view of the device as seen in the direction of the arrow II in FIG. 1, shown on a larger scale.

In accordance with FIGS. 1 and 2, the workpiece 7 covers a rectangular opening 14 which is developed in the support plate 3. Below the support plate 3 and below the opening 14 there are bearing brackets 15 and 16 which are mirror-images of each other. The bearing brackets 15, 16 are developed with bearings 17, 18 which are arranged on a guide 19. The guide 19 is formed by bars 20, 21 which also extend in the direction of the double-ended arrow 12 between frame walls 22, 23 and are fastened there. In accordance with DE 34 04 758 C2 (corresponding to U.S. Pat. No. 4,589,358) it is known, in sewing systems without turning devices, to arrange a stationary bearing bracket facing a sewing machine, while another bearing bracket is displaceable on rods.

The bearing brackets 15 and 16 are provided with bearings 24, 25 which extend in the direction of the double-ended arrow 26, perpendicular to the direction of the double-ended arrow 12. Rods 27, 28 are contained in the bearings 24, 25, fixed against rotation but displaceable in the direction of the double-ended arrow 26. These rods are developed with corner knives 29, 30 at their upper ends, these knives having, in accordance with the showing of FIG. 2, knives being V-shaped, as shown in FIG. 2. At their lower ends, the rods 27, 28 are connected to pistons 31, 32 which form parts of pneumatically actuatable piston-cylinder drives 33, 34.

The above-explained construction of the corner knives 29, 30 with the bearings 24, 25 and the piston-cylinder drives 33, 34 is of such a nature that the corner knives 29, 30 can in each case assume a lowered position A and an extended position B. In FIG. 1, the corner knives 29, 30 are shown in solid lines in their lowered positions A. Above that, the extended position B of the corner knife 30 is shown in dash-dot lines, the corner knife 30 extending through the opening 14. In the lowered position A, on the other hand, the corner knives 29, 30 are shown below the support plate 3. The operating movement of the corner knives 29, 30 is between the lowered and extended positions A, B.

Furthermore, the distance between the bearing brackets 15, 16 is adjustable by means of a size-adjustment device 35. The adjustment device 35 is developed with a stepping motor 36 the angle of rotation of which can be varied by a setting knob 37. The stepping motor 36 is connected, via a pulley (not designated by number), with a toothed belt 38 which is received on its free end by an opposite wheel 39. The latter is mounted on a bearing 40 of the frame 1. An upper course of the belt 41 is secured in position on the bearing bracket 15 by a clamp 42.

The above-mentioned structural parts, such as the sewing machine 4, the cloth clamp 6, the piston-cylinder drives 33, 34 and the size-adjusting device 35 are connected in controllable manner with a control unit (not shown), of the type described in the last-mentioned document.

Embodiment 1

On the bearing brackets 15, 16 there are developed bearings 43, 44 in which respective rods 45, 46 which are non-rotatable and displaceable in the direction of the double-ended arrow 26 are received. These rods are developed at their upper ends with turning tools 47, 48 and are connected at their lower ends to respective pistons 49, 50 of piston-cylinder drives 51, 52. The construction described above is effected in such a manner that each of the turning tools 47, 48 can be displaced between a lowered position D and an extended position E. In their positions D, the turning tools 47, 48 are below the support plate 3. In their positions E, the turning tools 47, 48 are located in a position in which they extend unimpeded through the opening 14, as the turning tool 47 is indicated in dot-dash lines in FIG. 1.

In contradistinction to the prior art, the bearing bracket 16 is also displaceable along the rods 20, 21. The bearing bracket 16 is connected for driving with a positioning drive 53 which is arranged on the frame 1. In accordance with this Embodiment 1, the positioning drive 53 has a piston-cylinder drive 54, the piston rod 55 of which is connected to the bearing bracket 16. The piston-cylinder drive 54 is provided with an adjustment screw 56 which is provided to adjust the stroke of the piston rod 55.

In contrast to the positioning drive 53 for the bearing bracket 16 which has the piston-cylinder drive 54, a positioning drive 57 for the bearing bracket 15 is provided by the stepping motor 36.

The positioning drives 53, 57 make it possible to displace the bearing brackets 16, 15 in opposite directions on the guide 19 so that the turning tools 47, 48 can be displaced in each case from their positions D to G and E to F, or vice versa. In FIG. 1 this displacement is indicated in the case of the bearing bracket 15 by dash-dot lines.

Likewise, the corner knives 29, 30 which are shown in their lowered positions A, are displaceable in this way from position A to position C, or vice versa.

Figure 5:
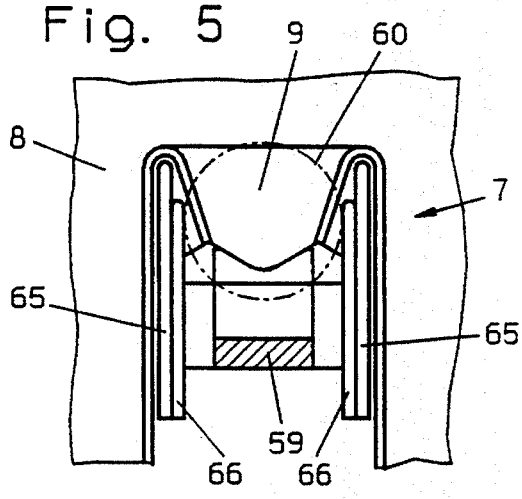
FIG. 5 is a view, in cross-section, corresponding to the section line V—V in FIG. 4, showing a cloth workpiece which has already been partly turned.
Figure 6:
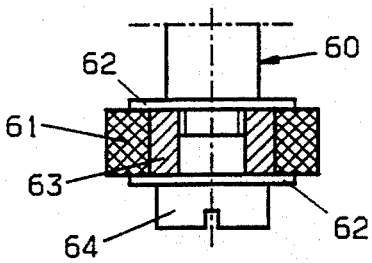
FIG. 6 is a detail view corresponding to part of FIG. 4 with structural parts shown in section, on a larger scale.
Figure 3:
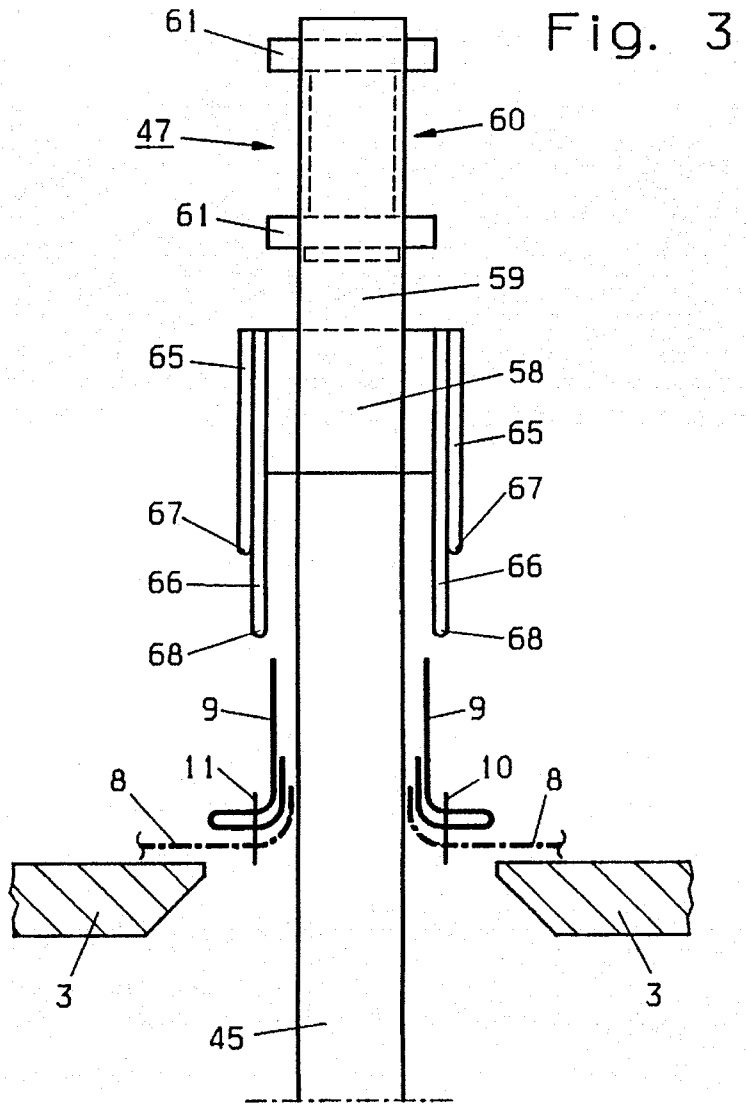
FIG. 3 is a view, in cross-section, taken along the section line III—III of FIG. 1, on a larger scale.
Figure 7:
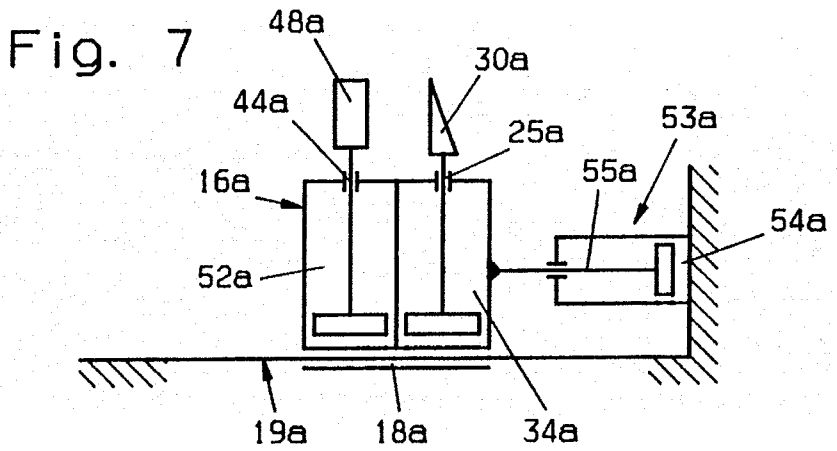
FIG. 7 is a diagram showing certain aspects of the invention in accordance with the first embodiment.

FIG. 7 diagrammatically shows the construction of this Embodiment 1, identical parts being provided with the same reference numbers used in FIGS. 1–6, with an added "a".

The development of the turning tools 47, 48 is fundamentally the same, so that, in order to avoid repetition, only the turning tool 47 will be described. The rod 45 terminates in a block 58 on which an angular support 59 is formed. On its free end (not provided with reference numeral) a stripper 60 is provided. The stripper 60 is developed as a rotating part and, in accordance with FIG. 6, is provided with rings 61 made of rubber or preferably Vulkollan polyurethane material which are arranged between two washers 62 on a spacer sleeve 63 and fixed in position by a screw 64. Furthermore, the block 58 is provided on each of its opposite sides (not provided with reference numerals) with plates 65, 66 which, for instance, are screwed fast to the block 58. In accordance with FIG. 3, the plates 65, 66 are provided with edges 67, 68 which are developed stepwise with respect to each other.

The size-adjustment device 35 described above is also adapted to displace the bearing bracket 15, corresponding to different lengths of pieces of cloth to be worked.

The piston-cylinder drives and positioning drives as well as other drive elements are connected to the above-mentioned control unit (not shown), for controlling the operation of the apparatus, which will be described below.

Embodiment 2

Figure 8:
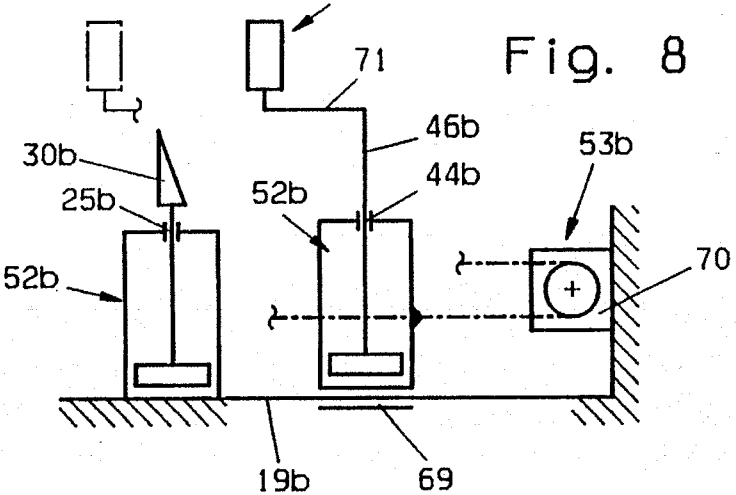
FIG. 8 is a diagram corresponding to FIG. 7, showing certain aspects of the invention in accordance with a second embodiment of the invention.

FIG. 8 diagrammatically illustrates a characteristic aspect Of a second embodiment of the apparatus, identical parts being provided with the same reference numerals, with the addition of a "b" in FIG. 8. This device is characterized, in particular, by the fact that the bearings 44*b* and 25*b* are formed in separate bearing brackets. Only the turning tool 48*b* is displaceable in the direction of the double-ended arrow 12, while the corner knife 30*b* remains continuously fixed with respect to the direction of the double-ended arrow 12. Accordingly, only the bearing bracket 52*b* which bears the turning tool 28*b* is supported displaceably on the guide 19*b* by a bearing 69. The positioning drive 53*b* is in this case formed by a stepping motor 70.

As can be noted from FIG. 8, the rod 46*b* bearing the turning tool 48*b* is provided with an offset 71. By providing suitable dimensions, this structure enables the corner knife 30*b* and the turning tool 48*b* to assume their positions corresponding to Embodiment 1 without interfering with each other.

Manner of Operation of Embodiments 1 and 2

The manner of operation of the first and second embodiments will be explained below with reference to Embodiment 1. In this connection, it is assumed that the corner knives 29, 30 are in their lowered positions A and that the turning tools 47, 48 are in their lowered positions D shown in solid lines in FIG. 1.

The workpiece 7 is placed on the sewing machine 4 with the seams 10, 11 and the interposed slit 13 between them, and is transported further by means of the cloth clamp 6 and positioned above the corner knives 29 and 30 and the turning tools 47, 48, in accordance with FIGS. 1, 2. Thereupon, corner cuts 72 and 73 are produced in the workpiece 7 at the ends of the slit 13, the corner cuts having identical V-shapes which are mirror images of each other. For simplification, only the V-shape of the corner cut 72 is shown in FIG. 2. For this purpose the piston-cylinder drives 33, 34 are controlled by the control unit to move the corner knives 29, 30 from their lowered positions A into their extended positions B and back again. As shown in FIG. 2, the ends of the arms of the corner cuts 72, 73 terminate in the vicinity of the ends of the seams 10, 11. The shapes of the corner cuts and their arrangement in the region of the seam ends are already known from the aforementioned prior art publications.

Figure 4:
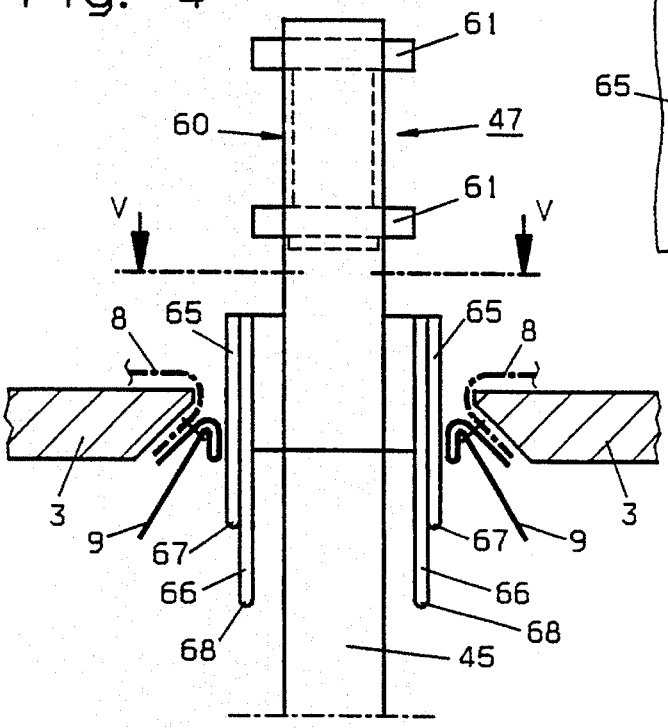
FIG. 4 is a view corresponding to FIG. 3 at a different stage of operation.

Thereupon, the control unit actuates the piston-cylinder drives 51 and 52, whereby the turning tools 47, 48 are moved from their lowered positions D into their extended positions E. In this connection, the turning tools 47, 48 extend through the slit 13 of the workpiece 7 with relatively little resistance, at positions spaced from the corner cuts 72, 73 by a distance away of 2 to 3 centimeters. Thereupon, the positioning drives 53, 57 are actuated, so that the bearing brackets 15, 16 are moved apart, together with the corner knives 29, 30 which are in lowered positions A and with the turning tools 47, 48 which are in the extended positions E. After the conclusion of this movement, the turning tools 47, 48 assume their positions F. This means that the turning tools 47, 48 have been positioned in positions located close to the corner cuts 72, 73. Then the piston-cylinder drives 51, 52 are reversed, as a result of which the turning tools 47, 48 are brought into their lowered positions G. During this movement, the edges 67, 68 of the plates 65, 66 come into engagement progressively with the edges (not provided with reference numerals) of the cloth parts 8, 9 and invert or turn them through the opening 14 in the support plate 3. This operation is shown in FIGS. 4 and 5. For better understanding, the stripper 60 is also shown in dash-dot lines in FIG. 5. The turning process is continued in such a manner that, after the above-mentioned action of the plates 65, 66, the stripper 60 then strips the cloth parts 8, 9, which have already been pulled-in, completely through the opening 14. When the turning tools 47, 48 reach their lowered positions G, the turning process is completed. Then the positioning drives 53, 57 are again reversed, so that the bearing brackets 15, 16 are moved towards each other and again assume their initial positions.

For turning the workpiece 7, it is particularly advantageous that the positions F of the turning tools 47, 48 which are located close to the corner cuts 72, 73, can be adjusted to the actual dimensions of the workpiece 7 by the adjusting elements, such as the setting knob 37 and the setting screw 56.

The manner of operation of the device in accordance with Embodiment 2 corresponds essentially to that of the Embodiment 1. The corner knives, of which only the corner knife 30*b* is shown in FIG. 8, remains stationary with respect to the direction of the double-ended arrow 12.

Embodiment 3

For the sake of simplification, components whose structure corresponds to that in Embodiment 1, have been given the same reference numbers, to which the letter "c" has been added.

Figure 12:
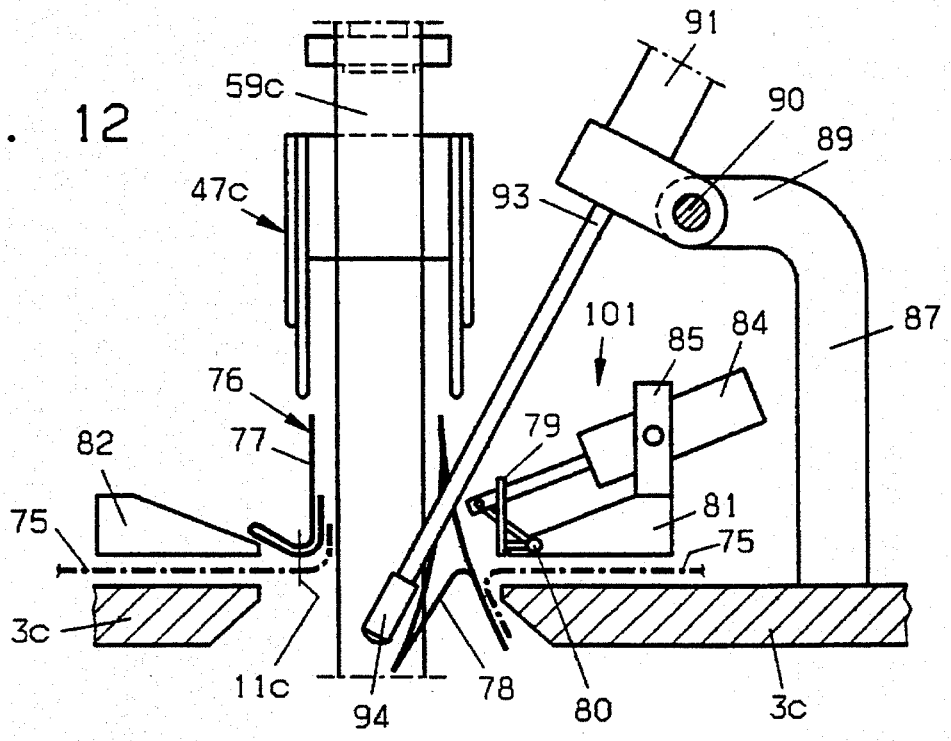
FIG. 12 is another view corresponding to FIG. 10, showing a further operating stage.

A frame 1*c* of a sewing system 2*c* is constructed, in the aforementioned manner, below a support plate 3*c* with a guide 19*c*, on which corner knives 29*c*, 30*c* and reversing tools 47*c* and 48*c* are accommodated. A fabric workpiece 74 lies on the support plate 3*c*. It includes a main piece of fabric 75, on which a fabric strip 76 lies (FIG. 12). The fabric strip 76 is connected with the main piece of fabric 75 by seams 10*c* and 11*c*, which run parallel to one another.

The fabric strip 76 has a left strip portion 77 and a right strip portion 78. Similar to the above-described fabric strip 9 (FIG. 3), the strip portion 77 is provided near the seam 11*c* with a fold (not labeled), while the right strip portion 78 has no fold and lies on a metal plate 79 in accordance with FIG. 10. The plate 79 is disposed in the form of a hinge over a pivot bearing 80 at a right fabric clamp part 81. Opposite the right fabric clamp part 81, a left fabric clamp part 82 is provided, the right and left fabric clamp parts 81, 82 together forming the fabric clamp 6*c*.

Figure 9:
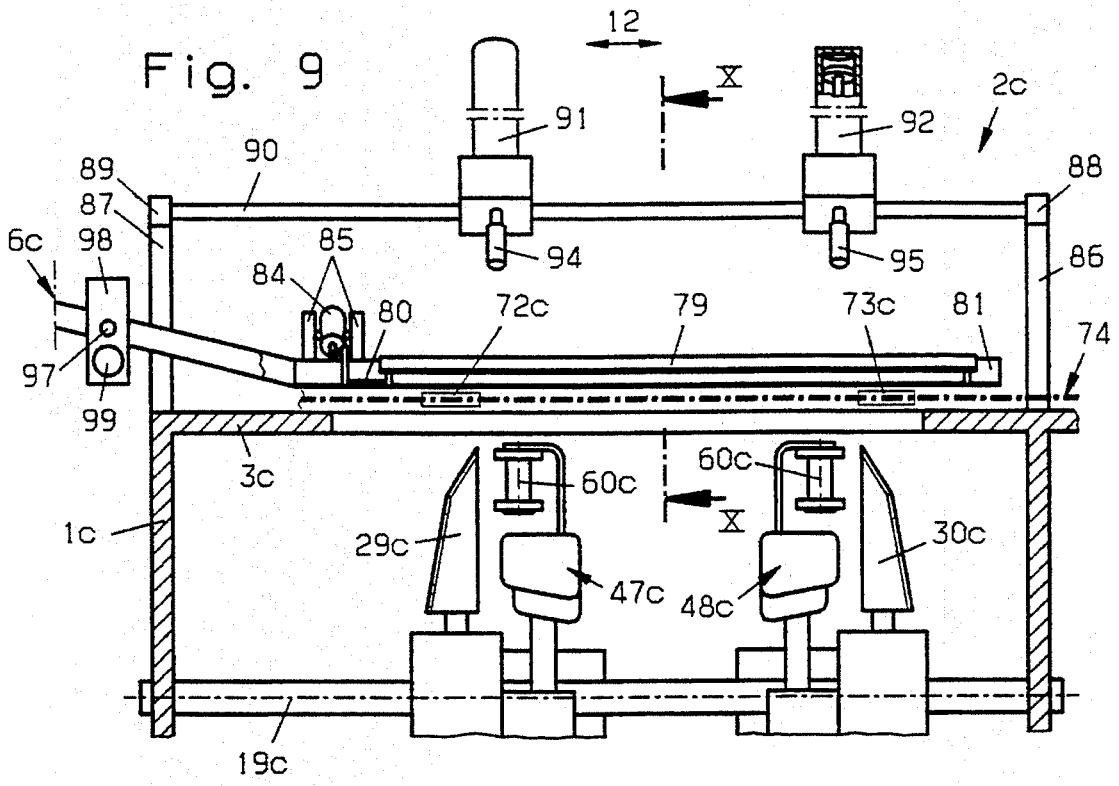
FIG. 9 is a front view corresponding to part of FIG. 1, showing a third embodiment of the invention.

The metal plate 79 is longer than the fabric strip 76, as can be seen in FIG. 9. Moreover, the metal plate 79 is hinged by means of a lever (not labeled) to a piston rod 83 of a pneumatic cylinder 84. The outer tube (not labeled) of the pneumatic cylinder 84 is pivotably mounted over a bolt (not labeled) in a fork 85, which is part of the right fabric clamp part 81. The arrangement of the pneumatic cylinder 84, described above, forms a pivot drive for the metal plate 79, which is dimensioned so that the metal plate 79 can be moved into the inclined position shown in FIG. 10 or into the vertical position shown in FIGS. 11 and 12. The plate 79 including its actuating elements and the pneumatic cylinder 84 form an orienting device 101 (FIG. 12) for acting on the right-hand strip portion 78, as will be described below.

Near the right fabric clamp part 81, columns 86 and 87 are fastened to the support plate 3*c*, which firmly accommodate at their 90° offset ends 88, 89 a rod 90. According to FIG. 9, a pair of ejectors 91, 92 (inserting devices) are mounted on the rod 90, in each case approximately above a respective stripper 60*c*. The ejectors 91, 92 have the same construction.

The more detailed description is therefore limited to the ejector 91.

Ejector 91 is constructed as a pneumatic cylinder and is provided on a piston rod 93 with an end piece 94. According to FIGS. 9 to 12, the ejector 91 (and likewise, the ejector 92) is slightly inclined to the vertical and fastened to the rod 90, so that the end piece 94 has the retracted position shown in FIGS. 10 and 11 and can assume the extended position of FIG. 12 when the pneumatic cylinder is acted upon appropriately. Correspondingly, the ejector 92 is provided with an end piece 95.

The arrangement of the metal plate 79 and the ejector 91 is such that there is no collision with the end piece 94 moving by, when the metal plate 79 assumes the aforementioned vertical position.

Figure 10:
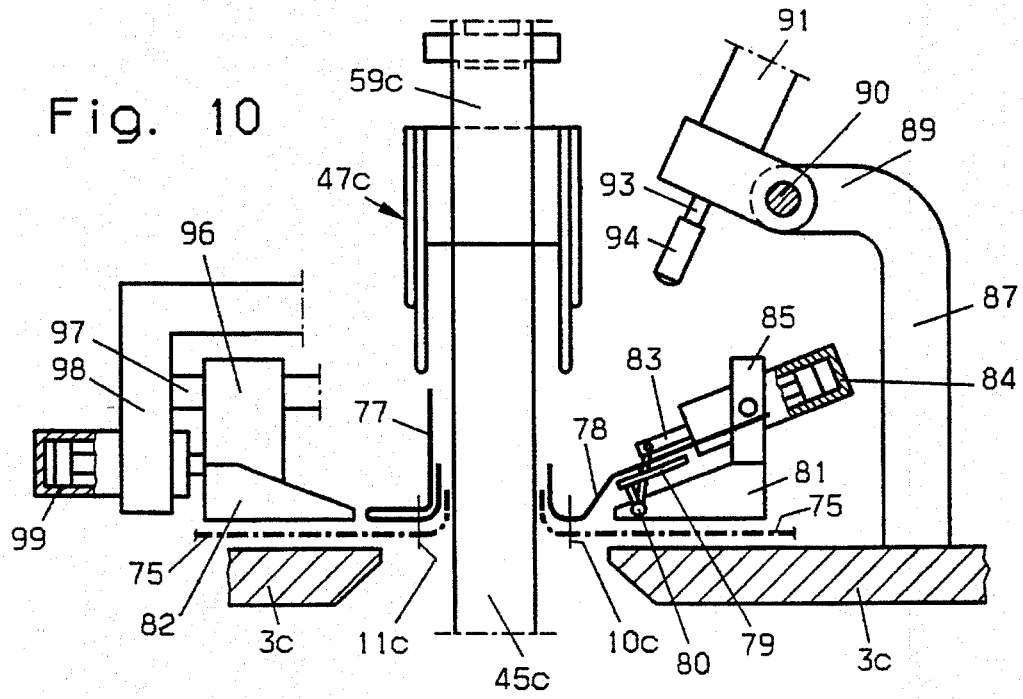
FIG. 10 is a sectional view taken along the line X—X of FIG. 9, on an enlarged scale.
Figure 11:
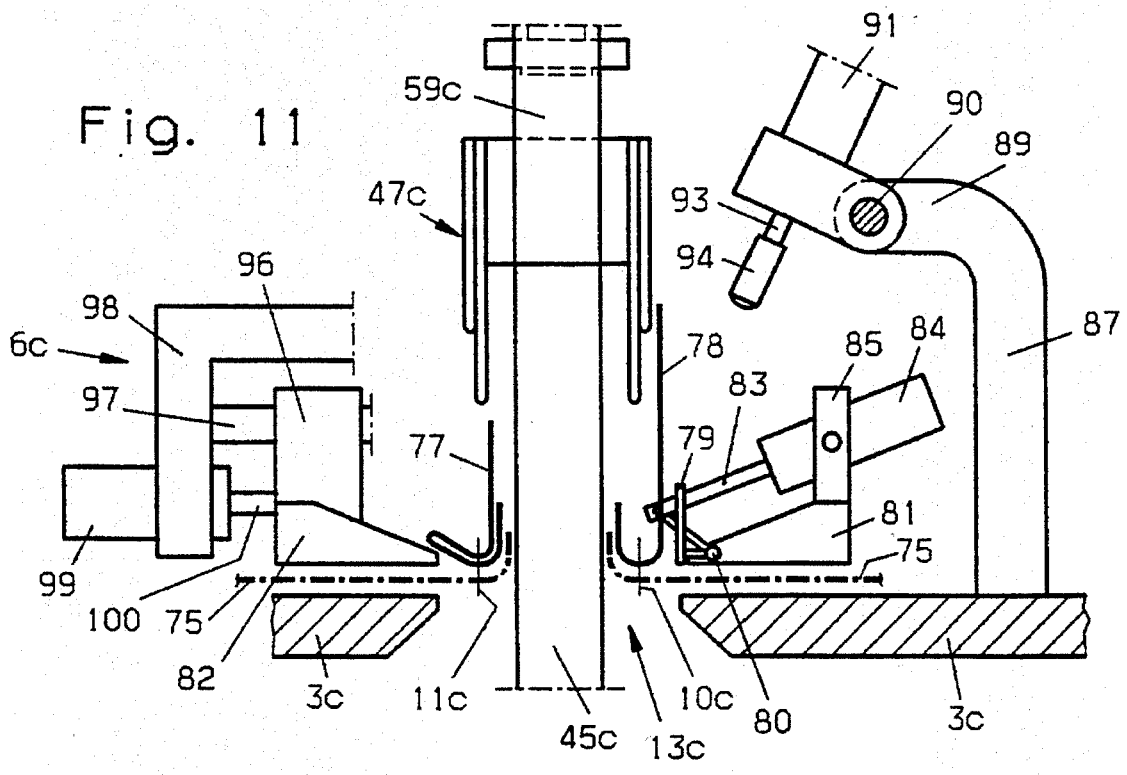
FIG. 11 is a view corresponding to FIG. 10, showing a different operating stage.

A sliding bearing 96, which is movably accommodated on a rod 97, is constructed on the fabric clamp 6*c*. This arrangement ensures that the left fabric clamp part 82 can be shifted parallel to the extent of the support plate 3*c*. Moreover, an arm 98 is disposed at the fabric clamp 6*c*, on which a sliding-drive mechanism 99 in the form of a pneumatic cylinder is provided. The latter has a piston rod 100, which is connected positively with the left fabric clamp part 82. The arrangement described above is dimensioned so that the left fabric clamp part 82 can be brought into a regular position as shown in FIG. 10 and into an "extended" position as shown in FIGS. 11 or 12. For purposes of clarification, it is noted that the "regular" position of the left fabric clamp part 82 corresponds to the position assumed during the cutting and reversing of the fabric part with the apparatus of Embodiment 1. Correspondingly, the left fabric clamp part 82, in its extended position, assumes a position in which it is closer to the right fabric clamp part 81.

The aforementioned pneumatic cylinder is also triggered by the control system (not shown), mentioned in connection with Embodiment 1.

Mode of Operation of Embodiment 3

The starting point is an initial position, shown in FIG. 10, in which the left fabric clamp part 82 is in its regular position, the metal plate 79 is in its inclined position, the ejectors 91, 92 are in their retracted position, and the reversing tools 47*c*, 48*c* are in their raised position, near the corner cuts 72*c*, 73*c*.

In this connection, reference is made particularly to the right fabric strip part 78 lying on the metal plate 79.

To begin with, the sliding-drive mechanism 99 is triggered and, at about the same time, that of the pneumatic cylinder 84, so that the left fabric clamp part 82 is positioned in the extended position and the metal plate 79 is positioned in the vertical position. The shifting of the left fabric clamp part 82 brings about a shift in the left fabric part 77, whereby the aforementioned fold is raised, that is, brought into a position favoring the subsequent reversing. With the swiveling of the metal plate 79 into the vertical position, the right fabric strip 78, which lies upon the metal plate 79, is also brought into a vertical position. The position, so achieved, is shown in FIG. 11.

Subsequently, the ejectors 91, 92 are triggered, so that the associated end pieces 94, 95 enter the slit (not numbered here) previously formed in the piece of fabric 74. This sequence of events is possible without collision of the end pieces 94, 95 with the reversing tools 46*c*, 47*c*, since the latter have already been moved apart, that is, positioned above the previously produced corner cuts 72*c*, 73*c*. With the extension of the end pieces 94, 95 into the slit, the right fabric strip 78 is partially reversed and, at the same time, the ends of the right fabric strip 78 are brought into the working region of the reversing tools 47*c*, 48*c*.

As the operation continues, there is a lowering of the reversing tools 47*c*, 48*c*, which take hold of the already preshaped regions of the left and right fabric strip parts 77, 78. After that, the control system causes a reversal of the ejectors 91, 92, so that the end pieces 94, 95 are shifted into their retracted positions. With the lowering of the reversing tools 47*c*, 48*c*, the reversal of the workpiece 74 is complete.

After the fabric clamp 6*c* is raised, the workpiece 74, the processing of which is finished, can be removed. At the same time, the control system causes the reversing tools 47*c*, 48*c* to be shifted on the guide 19*c* into the positions shown in FIG. 9 and the pneumatic cylinder 84 and the sliding-drive mechanism 98 to be reversed, so that, after the next workpiece has been loaded and further functions have run their course, the starting state, defined above, finally is reached once again.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An apparatus for cutting and reversing piped openings in a fabric workpiece which includes a fabric strip sewn by seams onto a main fabric piece, and a slit between the seams, comprising:

a support plate;

a pair of clamping parts for clamping the workpiece to the support plate on either side of the slit;

a pair of corner knives displaceable at least vertically from below the support plate for incising the ends of the slit; and a pair of reversing tools for reversing the fabric strip after the incision, the reversing tools being mounted on said apparatus for being introduced into the slit from below the support plate at positions spaced from the incised ends, and thereafter moved into an upper extended position above the support plate, and for being horizontally movable independently of the corner knives in opposite directions to one another in the longitudinal direction of the slit, for engaging the incised ends of the slit before reversing the fabric strip.

2. The apparatus of claim 1, further comprising bearings and driving mechanisms for the corner knives and reversing tools, wherein a bearing and a driving mechanism for the corner knives are independent of a bearing and a driving mechanism for the reversing tools.

3. The apparatus of claim 2, further comprising a positioning mechanism for positioning and moving the reversing tools during entry into the slit and during the movement in the longitudinal direction of the slit.

4. The apparatus of claim 3, wherein the positioning mechanism has a path adjusting device for adjusting the movement of the reversing tools.

5. The apparatus of claim 3, wherein the positioning mechanism includes a piston-cylinder driving mechanism.

6. The apparatus of claim 3, wherein the positioning mechanism includes a stepping motor.

7. The apparatus of claim 2, wherein the bearing parts for the corner knife and the reversing tool are comprised in bearing blocks.

8. The apparatus of claim 7, further comprising second driving mechanisms, including piston-cylinder driving mechanisms at the bearing blocks.

9. The apparatus of claim 2, further comprising a size-responsive adjusting device for adjusting the positions of the corner knives and reversing tools parallel to the slit in accordance with a longitudinal dimension of the piped opening to be produced.

10. The apparatus of claim 9, wherein the size-responsive adjusting device includes a servo-motor.

11. The apparatus of claim 1, wherein each reversing tool comprises a plate having a downwardly directed edge for engaging the fabric strip.

12. The apparatus of claim 11, wherein each reversing tool has a pair of downwardly directed edges in a stepped arrangment.

13. The apparatus of claim 12, wherein each reversing tool further comprises a stripper which includes a friction-increasing material, for engaging the fabric strip.

14. The apparatus of claim 13, wherein said friction-increasing material is rubber.

15. The apparatus of claim 13, wherein said friction-increasing material is polyurethane material.

16. The apparatus of claim 1, further comprising at least one inserting device disposed above the support plate for pushing the fabric strip downward at least partially into the slit, before the fabric strip is engaged by the reversing tools.

17. The apparatus of claim 16, wherein the inserting device is directed downward at an acute angle with respect to the support plate.

18. The apparatus of claim 16, further comprising a second inserting device, spaced from the first-mentioned inserting device in the longitudinal direction of the slit.

19. The apparatus of claim 18, wherein the inserting devices are disposed between the reversing tools, with respect to the longitudinal direction.

20. The apparatus of claim 16, wherein the inserting device includes a fluid-actuated cylinder with a piston rod, and an end piece on the piston rod for engaging the fabric strip.

21. The apparatus of claim 16, further comprising, above the support plate, an orienting device which is mounted on said apparatus for orienting at least part of the fabric strip at an acute angle or perpendicular to the support plate for being engaged by the reversing tools.

22. The apparatus of claim 21, wherein said orienting device comprises a plate for supporting said fabric strip at said angle.

23. The apparatus of claim 22, wherein the orienting device has a pressure fluid cylinder which is connected with the fabric clamp and has a piston rod connected to said plate.

24. The apparatus of claim 16, wherein the inserting device is disposed between the reversing tools, with respect to the longitudinal direction.

25. The apparatus of claim 16, wherein at least one of the fabric clamps is movable in the direction of the other fabric clamp.

26. The apparatus of claim 16, wherein the inserting device is mounted for being adjustable in the longitudinal direction with respect to the reversing tools.

27. An apparatus for cutting and turning piped openings in cloth workpieces which include a strip of cloth sewn by seams onto a main piece of cloth, and a slit between the seams, the apparatus comprising:

a support plate for receiving the workpiece;

a pair of corner knives for producing corner cuts at ends of the slit;

a pair of turning tools with edges for engaging and turning the workpiece;

a pair of first bearings in which the turning tools are movably received for displacement parallel to the slit;

a pair of second bearings in which the corner knives and the turning tools are received for displacement between a lowered position and a raised position for cutting and turning the workpiece, the corner knives and turning tools having independent respective second bearings;

a first drive for the displacement of the turning tools parallel to the slit; and a second drive for displacing the corner knives and the turning tools;

wherein the first drive has a positioning drive for guiding the turning tools initially for entry into the slit at positions remote from the corner cuts, and, after reaching the raised position, and before turning the workpiece, into positions located closer to the corner cuts.

28. A device according to claim 27, further comprising a control unit for controlling the apparatus to perform the following operating steps:

a) the workpiece is positioned on a support plate with the slit above corner knives and turning tools;

b) corner cuts are produced in the workpiece at the ends of the slit;

c) the turning tools are moved through the slit at positions remote from the corner cuts;

d) the turning tools are moved into positions located closer to the corner cuts;

f) the turning tools are then pulled downward and out of the workpiece in order to carry out the turning of the workpiece.

29. A device according to claim 27, wherein the positioning drive has a path-adjustment device.

30. A device according to claim 27, wherein the positioning drive includes a piston-cylinder drive.

31. A device according to claim 27, wherein the positioning drive includes has a stepping motor.

32. A device according to claim 27, wherein each of the bearing parts corresponding to the corner knives and the turning tools is supported on a bearing bracket.

33. A device according to claim 32, wherein the second drive for raising and lowering the corner knives and turning tools includes a piston-cylinder drive at the bearing bracket.

34. A device according to claim 27, further comprising a size-setting device for setting positions of the corner knives and the turning tools parallel to the slit in accordance with a lengthwise dimension of the braided opening to be produced; and the positioning drive includes a servomotor for actuating the size-setting device.

* * * * *